US005851009A

United States Patent [19]

Siebenmann

[11] Patent Number: 5,851,009

[45] Date of Patent: Dec. 22, 1998

[54] METHOD AND DEVICE FOR DECELERATING OR ACCELERATING AND/OR FOR DEFLECTING CONVEYED PRINTED PRODUCTS

[75] Inventor: Dieter Siebenmann, Russikon, Switzerland

[73] Assignee: Ferag AG, Hinwil, Switzerland

[21] Appl. No.: 759,037

[22] Filed: Dec. 2, 1996

[30] Foreign Application Priority Data

Dec. 5, 1995 [CH] Switzerland ..... 03433/95

[51] Int. Cl.[6] ..... A65H 5/34

[52] U.S. Cl. ..... 271/270; 271/182; 271/274; 271/314

[58] Field of Search ..... 271/119, 273, 271/274, 270, 182, 314

[56] References Cited

FOREIGN PATENT DOCUMENTS

| | | | |
|---|---|---|---|
| 0150655 | 8/1985 | European Pat. Off. | 271/182 |
| 0 345 418 | 12/1989 | European Pat. Off. . | |
| 34 06 069 | 8/1984 | Germany . | |
| 38 36 604 | 5/1990 | Germany . | |
| 43 16 051 | 12/1993 | Germany . | |
| 0211231 | 9/1987 | Japan | 271/119 |
| 0034849 | 2/1989 | Japan | 271/119 |
| 405105250A | 4/1993 | Japan | 271/119 |
| 405105262A | 4/1993 | Japan | 271/274 |
| 1440 489 | 6/1976 | United Kingdom | 271/314 |
| 2122976 | 1/1984 | United Kingdom | 271/182 |

*Primary Examiner*—H. Grant Skaggs
*Attorney, Agent, or Firm*—Walter C. Farley

[57] ABSTRACT

For decelerating, accelerating and/or deflecting conveyed printed products (3), pressing elements (1, 2) act on the printed products (3) with normal forces ($F_N$). The action is carried out in a resilient manner by contact elements (4) fixed to spring elements (5) such that the time of the action on the printed product (3) is made longer. Thus an improved deceleration or acceleration effect is achieved by means of friction forces and/or a deflecting effect is achieved by means of a momentum.

14 Claims, 6 Drawing Sheets

Fig.10
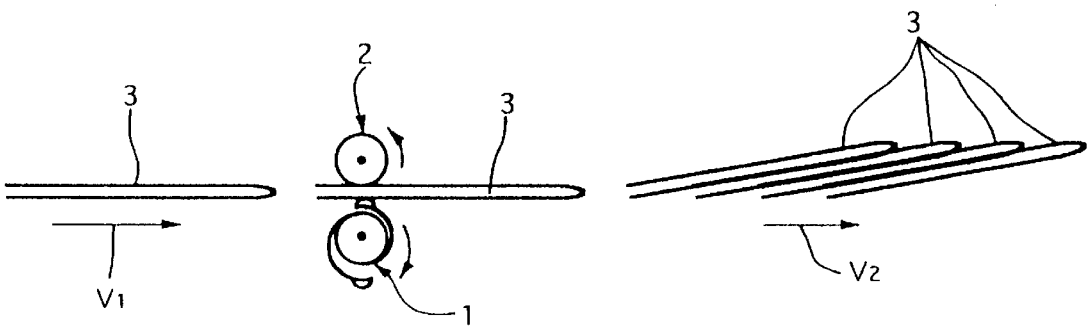
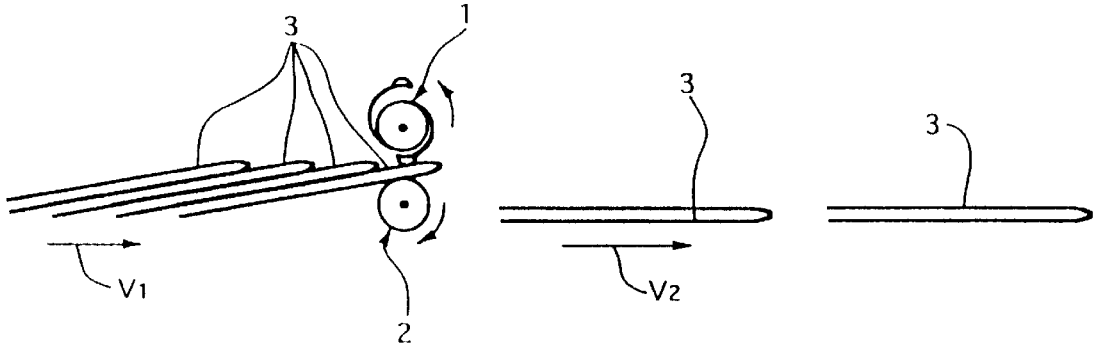
Fig.11

METHOD AND DEVICE FOR DECELERATING OR ACCELERATING AND/OR FOR DEFLECTING CONVEYED PRINTED PRODUCTS

FIELD OF THE INVENTION

The invention lies in the field of conveyance of printed products and concerns a method for decelerating, accelerating and/or deflecting printed products conveyed as a stream of printed products in a conveying direction and a device for carrying out the method. Method and device are designed for decelerating or accelerating and/or for deflecting printed products which are conveyed in a conveying stream.

BACKGROUND OF THE INVENTION

When processing printed products it is sometimes necessary to change the conveying speed of the printed products between different processing steps. Thus e.g. the printed products leaving in succession the folding apparatus of a rotary printing machine at a high speed of e.g. 10 m/s must be decelerated to a lower speed of e.g. 1 m/s for forming a scaled stream. The scaled stream is basically formed by means of a feeding spider wheel synchronized with the folding apparatus. The printed products arriving at high speed impinge on the bottom of the compartments of the feeding spider wheel which runs at a lower speed. Without suitable means for controlling the impingement, the position of the printed product in the compartment of the feeding spider wheel is uncontrolled and/or at a slant angle. The impingement can also lead to damaging the printed product: the forward facing part of a printed product can be damaged directly by the impingement, while the backward facing part can be damaged by crushing due to the impingement. There are known methods and devices having the object to control the impingement, e.g. to reduce the impingement speed or to deflect the printed products.

A method and a device for reducing the speed of impingement of a stream of printed products is e.g. described in the publication DE-34 06 069. Herein the printed products are gripped for a short time in the area of their upstream end, are decelerated and then are released. The decelerating device substantially consists of cam wheels running with reduced circumferential speed and functionally coupled with cooperating rings driven in the opposite direction. A similar device allowing simple adjustment to different format lengths of printed products while the machine is running is described in the patent application EP-0 390 736. These two mentioned inventions have the disadvantage that they only act on the printed products for a very short time and therefore the decelerating effect is accordingly small.

Further devices for decelerating a stream of printed products are known from publication DE-43 16 051 and from patent application EP-0 484 653. Herein the printed products are decelerated by brushes. Both devices act on downstream ends of the products; therefore, the danger of damaging the printed products and of smudging the printing ink in areas of friction is considerable.

None of the known methods and devices allow a selectable deceleration or acceleration and/or deflection of the printed products.

SUMMARY OF THE INVENTION

An object of the present invention is to show a method and to create a device which allow to selectably decelerate or accelerate and/or deflect printed products, whereby only one end of the printed products is acted on and nonetheless the method and device achieve an optimal deceleration, acceleration and/or deflecting effect.

The basic idea of the inventive method consists in acting on the printed products with a pressing element and a counter element exerting periodical normal forces onto a stream of conveyed printed products whereby the parts contacting the printed products of at least the pressing element are resilient such that the acting time is increased. The pressing elements can e.g. be tappets fixed to spring elements which are fitted to a rotating cylinder. Due to the rotation of the cylinder, the contact elements periodically act on the stream of products by means of controlled impingement at the right moment. Due to the spring elements, the contact elements have contact with the printed products over a longer distance or for a longer time respectively and thus an improved effect is achieved.

If the forces act on the two main surface of a printed product in the form of a pair of forces acting perpendicular to the main surfaces, directed against each other and aligned with each other mainly friction is caused. With this friction the printed product can be decelerated or accelerated selectably. Normal forces acting on the two main surfaces of the printed products as pairs of forces which are not aligned they cause a momentum acting on the printed product. With this momentum the printed product can be deflected. The deceleration or acceleration and the deflecting respectively can also be carried out with one single method and one single device.

BRIEF DESCRIPTION OF THE DRAWINGS

Several variants of the inventive method and the inventive device are described in more detail in connection with the following Figures, wherein:

FIG. 10 is a schematic drawing for the application of the inventive method for decelerating products in a non-scaled stream and FIG. 11 is a schematic drawing for the application of the inventive method for accelerating products in a scaled stream.

DESCRIPTION OF PREFERRED EMBODIMENTS

Figure 1:
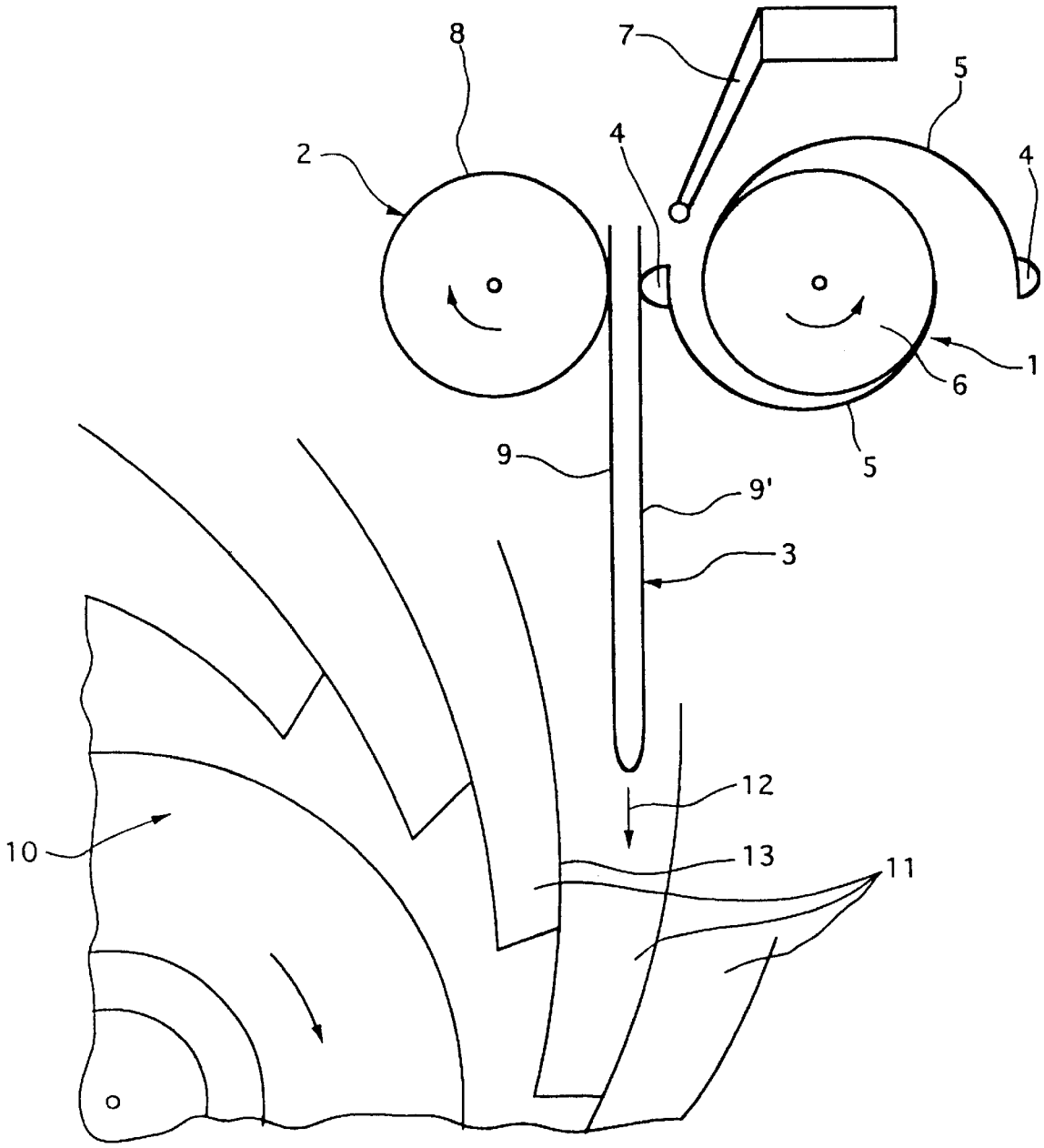
FIG. 1 is a schematic cross section of an embodiment of the inventive device.

FIG. 1 shows a cross section of an embodiment of the inventive device. A first pressing element 1 and a second pressing element 2 are arranged substantially stationary such that a printed product 3 can be clamped between them.

The pressing element 1 in this example comprises two contact elements 5 which are arranged on spring elements 5. The spring elements 5 again are fitted to a drive element 6 for moving the contact elements. In the example shown in FIG. 1, the contact elements 4 are designed as tappets. They act periodically and in a synchronized manner on the stream of printed products 3. The spring elements 5 are e.g. flection springs (pieces of band or spiral spring); they are adjusted such that they are tensioned when the corresponding contact element 4 is in contact with a printed product 3. Near the pressing element 1 a template 7 is provide which influences the course of movement of the contact elements 4 e.g. by first tensioning the spring elements 5 and then letting the contact elements 4 impinge in a controlled manner onto a printed product 3 at exactly the right moment. The controlled, abrupt impingement of the contact element 4 onto a printed product 3 results in a sudden controlled clamping of the printed product 3 between pressing and counter element 1 and 2. The pressing element 1 can comprise one contact element 4 only or more than two contact elements 4 and a corresponding number of spring elements 5.

The counter element 2 is e.g. designed as a roller pressing with its surface 8 directly on one of the main surfaces 9 of the printed product. A feeding spider wheel, not belonging to the invention, which comprises compartments 11 for taking over printed products 3 is also shown.

The inventive method is explained in connection with the examples according to FIGS. 2 and 3. In these Figures, as in FIG. 1, a pressing element 1 and a counter element 2 as well as a printed product 3 is shown diagrammatically. Pressing and counter element 1 and 2 rotate in opposite directions and the printed product 3 is conveyed between pressing and counter element 1 and 2 in a conveying direction indicated by arrow 12. In order to simplify the drawing, only one contact element is shown on pressing element 1. It is shown in three positions: in a waiting position 4.1 (broken lines) and in a decelerating or accelerating position 4.2 in FIG. 2, as well as in a deflecting position 4.3 in FIG. 3. Due to the rotation of the drive element 6, the contact element is moved through the three positions in succession. In the waiting position the template 7 keeps the contact element 4.1 at a distance from the printed product 3 by tensioning the spring element 5.1 and by pressing the contact element 4.1 closer to the drive element 6. As soon as the contact element is moved out of the influence of the template 7 the spring element 5 is released partly and the contact element 4 impinges onto the upstream part of the printed product 3. This has the advantage that the downstream end is not affected and not damaged and that the printed product 3 is not crushed.

Pressing and counter element 1 and 2 act on the printed product 3 substantially with normal forces $F_N$, i.e. forces which are orientated substantially perpendicular to the main surfaces 9, 9' of the printed product 3. Regarding the normal forces $F_N$, two cases are to be distinguished.

Figure 2:
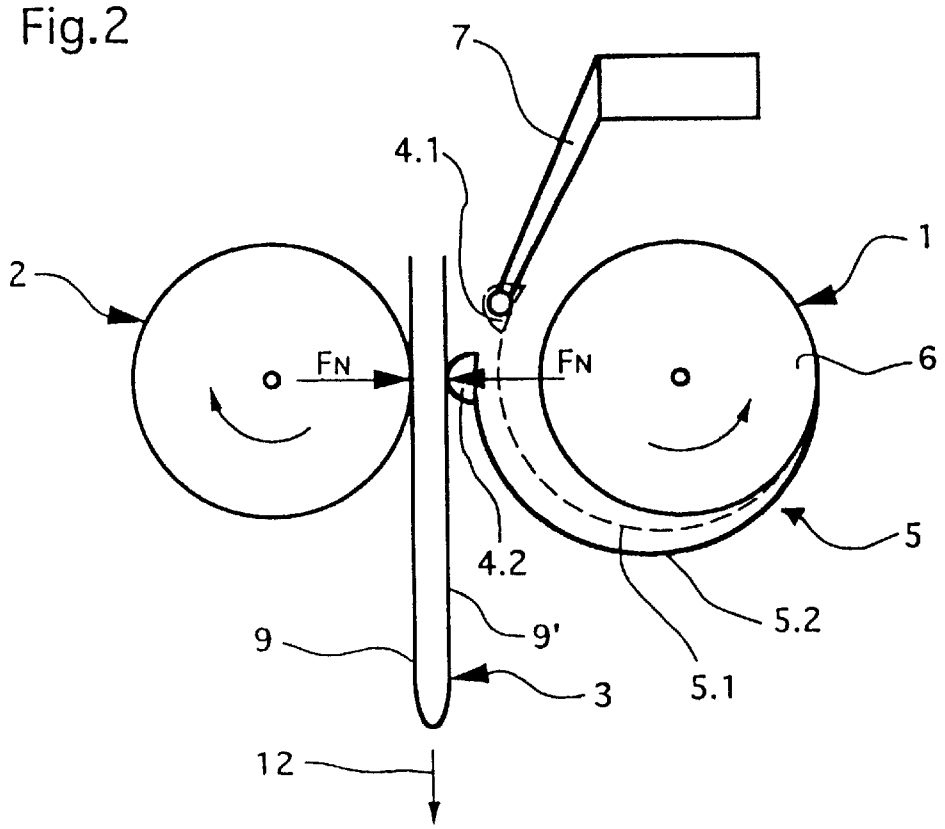
FIG. 2 is a schematic representation of the inventive method for decelerating or accelerating printed products respectively.

In a first case, which is shown in FIG. 2, the two normal forces $F_N$ act opposite to each other (are aligned to each other). In this case mainly friction forces act on the printed product 3 which friction forces can be exploited for decelerating and accelerating the printed product 3. The printed product 3 is decelerated if pressing and counter element 1 and 2 which are in contact with it have a lower speed than the printed product or if they move in the opposite direction to the printed product. If a printed product 3 with a mass m is supplied with an initial speed $v_1$, the pressing and the counter element 1 and 2 press the printed product 3 with normal forces $F_N$ on both sides and the sliding friction coefficient between the main surfaces 9, 9' of the printed product 3 and the pressing elements 1 and 2 is $\mu_G$, the end speed $v_2$ of the printed product 3 after a decelerating distance s is:

$$v_2=(v_1-4\mu_G F_N s/m)^{1/2}.$$

The printed product 3 is accelerated if the parts of the pressing and the counter element 1 and 2 which are in contact with the printed product 3 have higher speeds than the printed product 3. For the end speed $v_2$ of printed product 3, the above formula is valid, whereby the minus sign must be replaced with a plus sign. Instead of the sliding friction the static friction can be exploited for decelerating or accelerating printed products 3 also.

Figure 3:
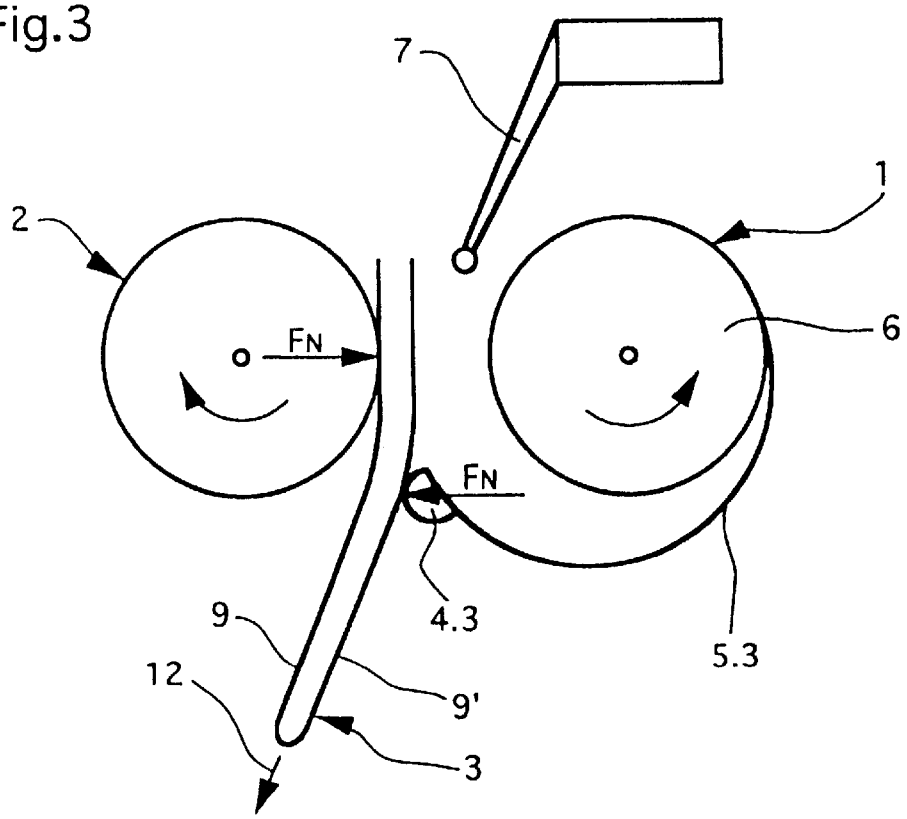
FIG. 3 shows a diagrammatic representation of the inventive method for deflecting printed products.

In a second case, which is shown in FIG. 3, two normal forces $F_N$ act on the printed product 3 in a not-aligned manner. In this case mainly a momentum acts on the printed product 3 which momentum can be exploited for deflecting the printed product 3. Deflecting printed products 3 can e.g. be necessary for bringing them precisely into the compartment 11 of the feeding spider wheel 10 shown in FIG. 1 or for pressing them against an area 13 inside such a compartment 11 for achieving a decelerating effect. The first case, described above, and the second case can also be carried out in the same one method and by the same one device.

Two characteristics are substantial for the inventive method. Firstly, the acting elements 1 and 2 press periodically in a predetermined moment onto the stream of printed products such that they e.g. only affect the upstream part of printed products 3 and do not damage the downstream part. Secondly, pressing and counter element 1 and 2 act on the printed products 3 over a longer time or over a longer distance respectively by which an improved decelerating, accelerating and/or deflecting effect is achieved.

Figure 4:
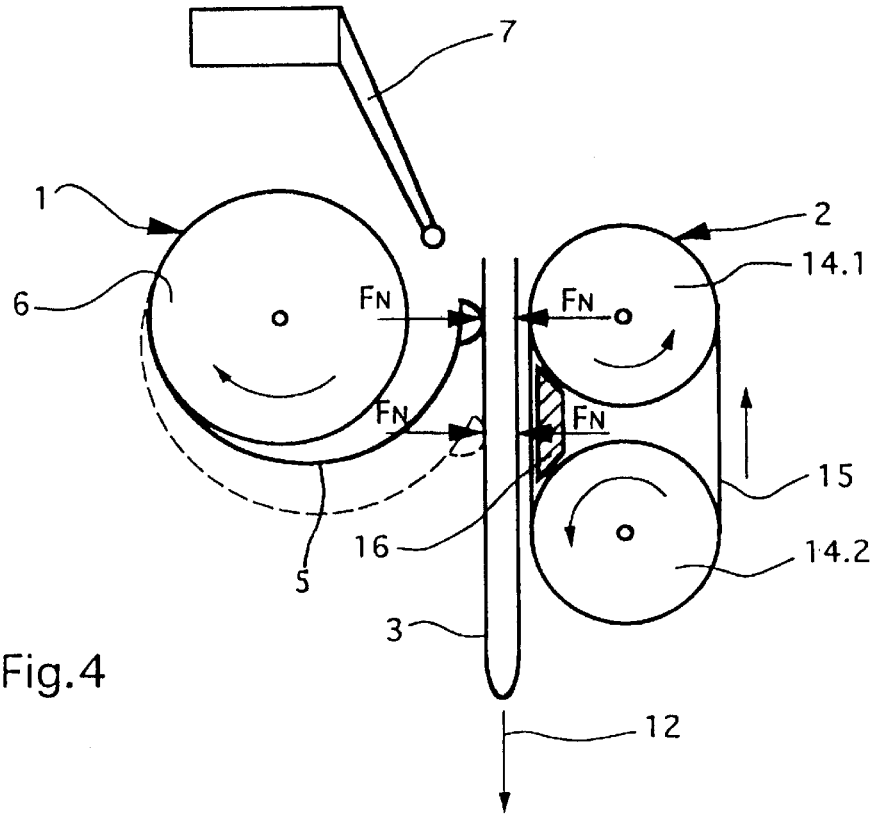
FIGS. 4–9 are schematic drawings of different variants of the inventive method.

FIG. 4 shows a variant of the inventive method in which the counter element 2 consists of two rollers 14.1, 14.2 and a belt 15 running on these rollers. The belt 15 can, at least on the side facing the printed product 3, be supported by a supporting element 16. In this arrangement, two normal forces $F_N$ act on the printed product 3 over a longer distance; in other words: the deceleration or acceleration position respectively is maintained over a longer time while a deflecting position never occurs. This variant is especially suited for decelerating or accelerating printed products 3.

Figure 5:
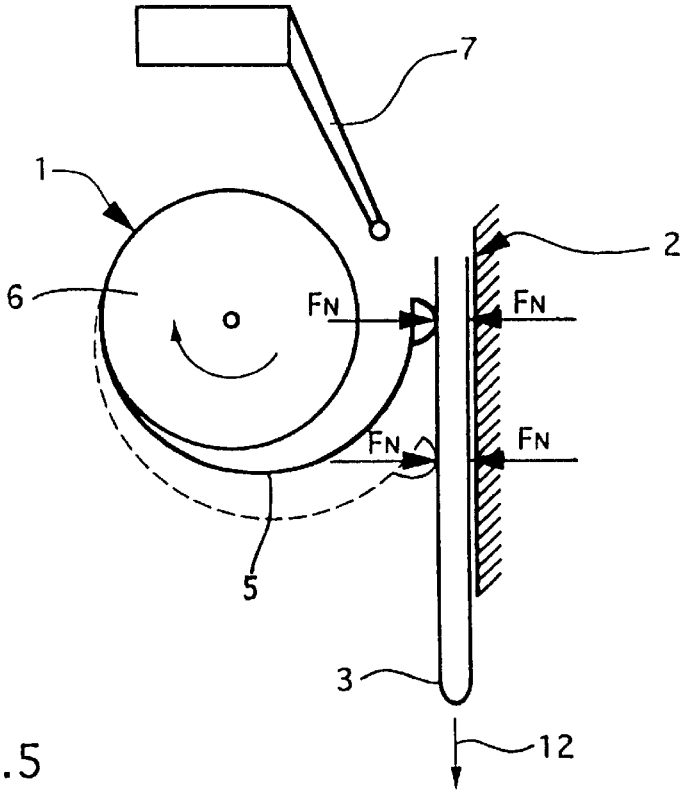

In the method variant according to FIG. 5, the counter element 2 is a stationary, fixed wall. This arrangement is suited for decelerating printed products 3. The wall 2, in analogy to the belt 15 in FIG. 4, guarantees a longer decelerating phase.

Figure 6:
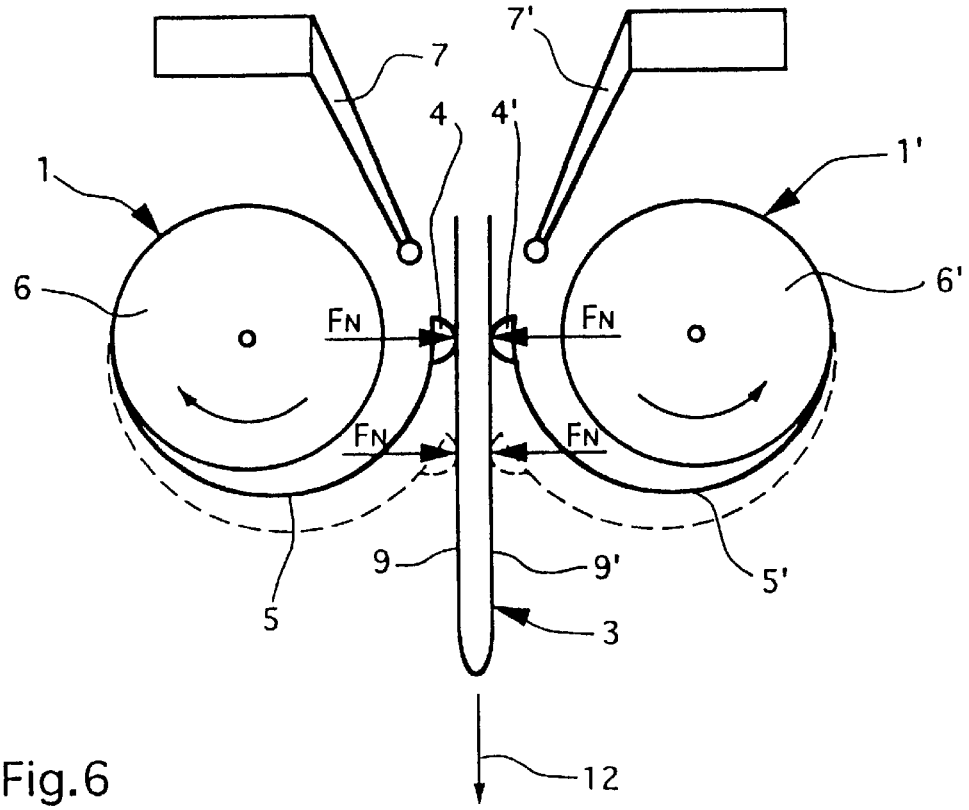

A longer decelerating or accelerating phase can also be achieved with the method variant shown in FIG. 6. Here pressing and counter element 1 and 1' are both designed as pressing elements according to the preceding figures, i.e. they are both equipped with spring elements 4, 4' and contact elements 5, 5'. The arrangement is symmetrical regarding the two main surfaces 9 and 9' of the printed product 3 and acts substantially symmetrically on the printed product 3.

Figure 7:
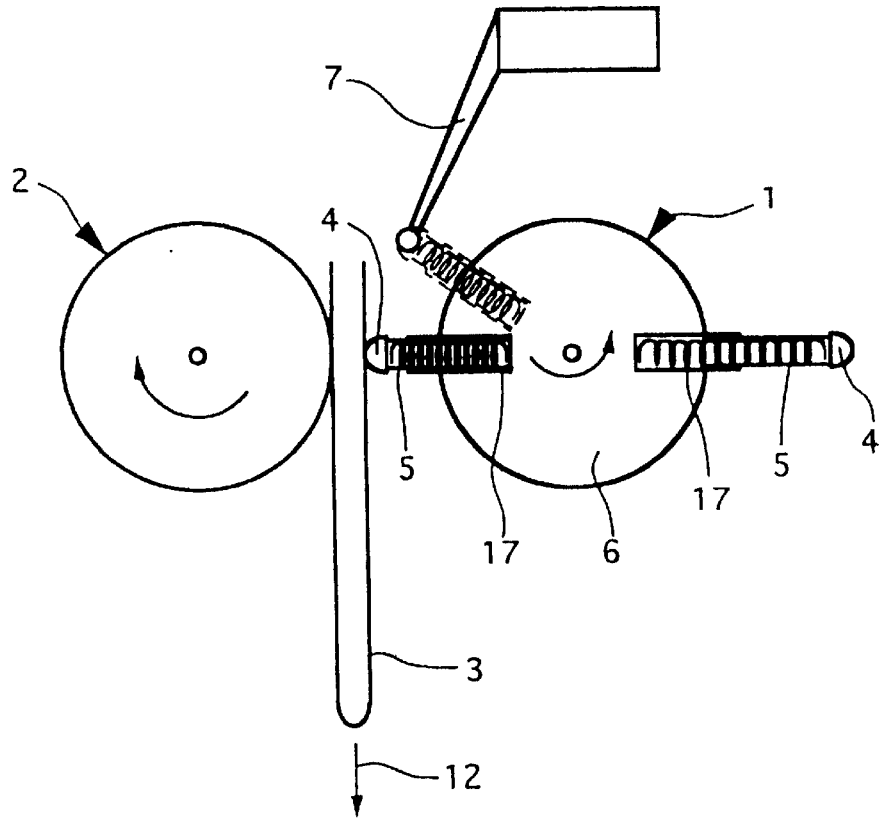

FIG. 7 shows a method variant in analogy to FIG. 2 for which the spring elements 5 are designed differently. Instead of flection springs, compression springs or coil springs are used for fitting the contact elements 4 to the drive element, which coil springs 5 can e.g. be guided in cylinders 17. These spring elements have a substantially identical effect as the spring elements according to FIGS. 1 to 6.

Figure 8:
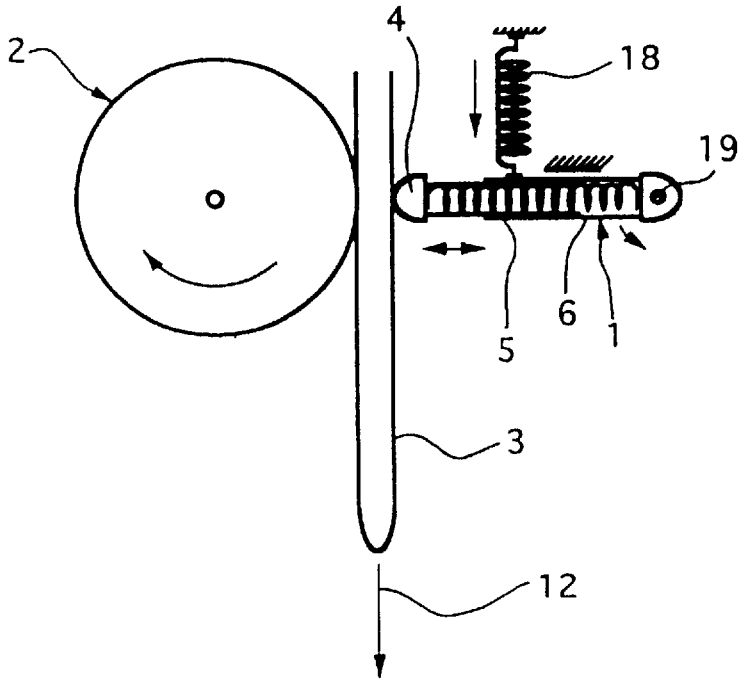

A totally different pressing element is shown in FIG. 8. The drive element 6 is substantially a hollow cylinder on which a sticking out spring element 5 is provided, which spring element carries a contact element 4. The hollow cylinder is mounted slewably around a stationary axis 19 such that during an acting phase it is driven by the products in conveying direction 12 and it is returned in the opposite direction during a waiting phase by a second spring element 18, e.g. a coil spring. Contact element 4 is, in analogy to FIG. 7, e.g. fitted to the drive element 6 by a coil spring 5. Thus, a longer action of the pressing elements 1 and 2 on the printed products 3 is made possible. The stationary axis 19 is orientated perpendicular to the conveying direction 12.

Figure 9:
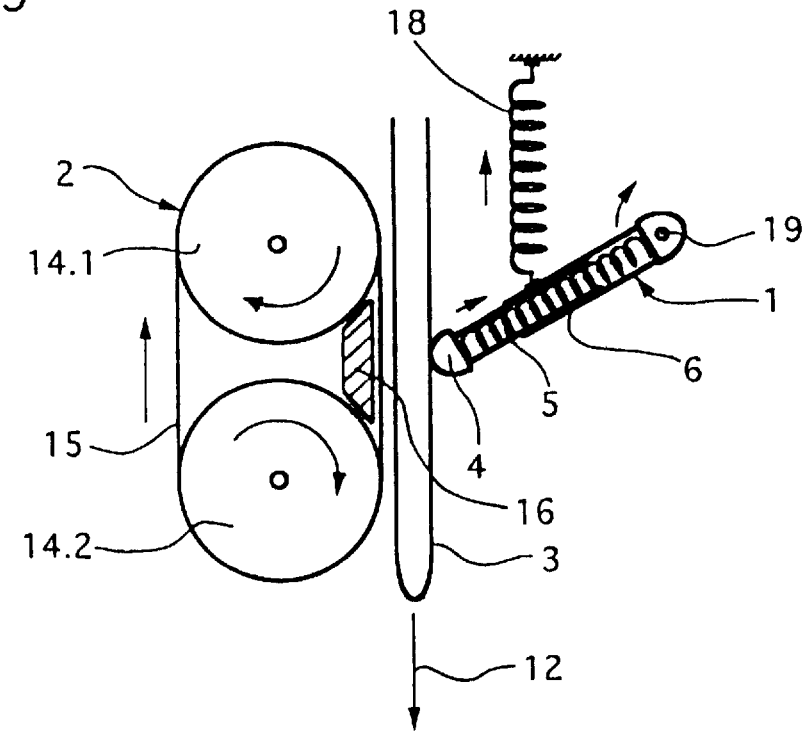

Obviously, combinations of the characteristics described above are also included in the teaching of the present invention. As an example for such a combination, FIG. 9 shows a first pressing element 1 according to FIG. 8 and a second pressing element 2 according to FIG. 4.

FIG. 10 shows diagrammatically the application of the inventive method for decelerating printed products 3 supplied in a linear manner. The printed products 3 are supplied with a small spatial density and with a high speed $v_1$ in form of a non-scaled stream. They are decelerated according to the inventive method and are conveyed away with an increased spatial density and with a lower speed $v_2<v_1$. Pressing and counter element 1, 2 are advantageously applied to the upstream product ends in order to prevent the printed products 3 from being crushed.

FIG. 11 shows diagrammatically the application of the inventive method for accelerating printed products 3 supplied in a linear manner. The printed products 3 are supplied with a large spatial density and with a low speed $v_1$ in the form of a scaled stream. They are accelerated according to the inventive method and conveyed away with a smaller spatial density and with an increased speed $v_2>v_1$. Pressing and counter element 1 and 2 are advantageously applied to the downstream product ends in order to prevent the printed products 3 from being crushed.

Summarizing it can be said, that in the method for decelerating or accelerating and/or for deflecting conveyed printed products 3, at least one pressing element 1 and at least one counter element 2 periodically act on a stream of conveyed printed products 3 by applying forces $F_N$ either only to the downstream ends or only to the upstream ends of the printed products 3 which forces are orientated substantially perpendicular to the main surfaces 9, 9' of the printed products 3. As the forces are applied by springy members the acting time becomes longer.

The device for carrying out the method has at least one pressing element 1 and at least one counter element 2. With the help of the pressing and counter elements forces $F_N$ are applied substantially perpendicular to the main surfaces 9, 9' of the printed products 3. The at least one pressing element 1 comprises contact elements 4 fitted to a drive element 6 via a spring element 5.

I claim:

1. A method for selectively accelerating or decelerating printed products being conveyed in a conveying direction parallel to main surfaces of the products, each of the products having two generally parallel main surfaces, the method comprising the steps of:

providing a counter element having a contact area, conveying the products in a product stream past the counter element such that the contact area of the counter element is substantially parallel with one main surface of each product being conveyed past the counter element, providing at least one spring mounted contact element, and acting on a second main surface of a product being conveyed past the counter element with the at least one spring mounted contact element, the step of acting including abruptly moving the contact element against the second main surface of the product, thereby pressing the product with a sudden clamping force between the contact element and the contact area of the counter element, and moving the contact element substantially parallel with the conveying direction substantially maintaining the clamping force on the product between the contact element and at least part of the contact area.

2. A method according to claim 1 wherein the step of acting includes moving the contact element beyond a downstream end of the contact area to deflect the product away from the contact element acting on it.

3. A method according to claim 1 wherein the step of abruptly moving the contact element includes holding the contact element on a spring element, tensioning the spring element with a template, and releasing the spring element and contact element from the tensioned position caused by the template into clamping contact with the product, the clamping contact being positioned so that a portion of the tensioning force is retained.

4. A method according to claim 1 including, for decelerating the product, holding the contact area of the counter element stationary.

5. A method according to claim 1 including, for decelerating the product, holding the contact area of the counter element stationary, and moving the contact element in the conveying direction and more slowly than conveyance of the product stream.

6. A method according to claim 1 including, for accelerating the product, moving the contact area of the counter element in the conveying direction faster than the product stream.

7. A method according to claim 6 further including moving the contact element in the conveying direction faster than the product stream.

8. A method according to claim 1 and including, in moving the contact element against the product, engaging an upstream portion of the product.

9. A method according to claim 1 including, for decelerating the product, moving the contact area of the counter element in a direction opposite to the conveying direction.

10. A method according to claim 1 including, for decelerating the product, moving the contact element in the conveying direction more slowly than the product.

11. A device for selectively accelerating or decelerating printed products being conveyed in a conveying direction parallel to main surfaces of the products, each of the products having two generally parallel main surfaces, comprising the combination of means for conveying products in a product stream in a conveying direction;

means for mounting a counter element with a contact area facing one main surface of a product being conveyed in said stream past said counter element;

a spring mounted contact element; and means for supporting said contact element for movement substantially parallel with said conveying direction and for abrupt movement toward said contact area, whereby said contact element moves against said product to clamp said product between said contact element and said contact area with a clamping force and moves along said conveying direction to maintain said clamping force against at least part of said contact area.

12. A device according to claim 11 wherein said means for supporting said contact element includes a rotating drive element and a spring mounting said contact element on said drive element, said device further including a template for restraining said contact element from movement toward said contact area, thereby tensioning said spring, and for selectively releasing said contact element to clamp said product.

13. A device according to claim 11 wherein said counter element comprises a roller having an axis of rotation substantially parallel with said main surfaces of said product.

14. A device according to claim 13 and including rotating said roller against said product during application of said clamping force.

* * * * *